US007819250B2

(12) United States Patent
Sattel et al.

(10) Patent No.: US 7,819,250 B2
(45) **Date of Patent: *Oct. 26, 2010**

(54) CHILD-PROOF CARTON PACKAGE

(75) Inventors: Oliver Sattel, Geislingen (DE); Meino Adam, Heidenheim (DE); Juergen Dambacher, Eberbach (DE); Dirk Bauernfeind, Wurzach (DE); Peter Fuhrmann, Laupheim (DE); Detlev Gertitschke, Laupheim (DE); Holger Bugar, Schwendi (DE)

(73) Assignees: Carl Edelmann GmbH (DE); Uhlmann Pac-Systeme GmbH & Co. KG (DE)

( * ) Notice: Subject to any disclaimer, the term of this patent is extended or adjusted under 35 U.S.C. 154(b) by 297 days.

This patent is subject to a terminal disclaimer.

(21) Appl. No.: 11/716,293

(22) Filed: Mar. 9, 2007

(65) Prior Publication Data

US 2008/0217205 A1 Sep. 11, 2008

(51) Int. Cl.

| | |
|---|---|
| ***B65D 1/09*** | (2006.01) |
| ***B65D 5/38*** | (2006.01) |
| ***A45C 13/10*** | (2006.01) |
| ***A45C 13/18*** | (2006.01) |

(52) U.S. Cl. ..... 206/528; 206/1.5; 229/125.125

(58) Field of Classification Search ..... 206/528–534.2, 206/536, 538, 807, 1.5; 229/102, 125.125
See application file for complete search history.

(56) References Cited

U.S. PATENT DOCUMENTS

| | | | | |
|---|---|---|---|---|
| 4,125,190 | A | 11/1978 | Davie, Jr. et al. | |
| 6,047,829 | A | 4/2000 | Johnstone | |
| 6,230,893 | B1 * | 5/2001 | Karow | 206/531 |
| 6,412,636 | B1 | 7/2002 | Jones et al. | |
| 6,491,211 | B1 * | 12/2002 | Evans et al. | 229/102 |
| 6,752,272 | B2 * | 6/2004 | Jones et al. | 206/534 |
| 7,090,079 | B2 * | 8/2006 | Ehrlund | 206/531 |
| 7,389,875 | B2 * | 6/2008 | Sandberg et al. | 206/531 |
| 2003/0085262 | A1 | 5/2003 | Evans et al. | |
| 2004/0050748 | A1 * | 3/2004 | Ehrlund | 206/538 |
| 2007/0068843 | A1 * | 3/2007 | Hession | 206/538 |
| 2008/0217204 | A1 * | 9/2008 | Sattel et al. | 206/531 |

FOREIGN PATENT DOCUMENTS

| | | | |
|---|---|---|---|
| EP | 1 002 744 | A1 | 5/2000 |
| EP | 1 057 744 | A1 | 12/2000 |
| EP | 1 270 440 | B1 | 12/2003 |
| FR | 2 649 672 | A | 1/1991 |
| FR | 2 706 419 | A | 12/1994 |
| WO | WO 03/101840 | A | 12/2003 |

* cited by examiner

*Primary Examiner*—Mickey Yu
*Assistant Examiner*—Melissa L Lalli
(74) *Attorney, Agent, or Firm*—Jansson Shupe & Munger Ltd.

(57) ABSTRACT

A childproof package consists of a rectangular folding box of cardboard with at least one strip-like blister pack inside, which can be pulled out from one of the short, narrow sides of the folding box. The folding box is designed so that it can be reclosed in such a way as to be childproof again, and the folding box and the blister pack have cooperating means, which are designed so that the blister pack cannot be pulled completely out of the folding box.

5 Claims, 2 Drawing Sheets

CHILD-PROOF CARTON PACKAGE

AREA OF THE INVENTION

The invention pertains to a package consisting of a rectangular folding box of cardboard with at least one strip-like blister pack inside, which can be pulled out from one of the short, narrow sides of the box.

PRIOR ART

Packages of this type are known in general in the form of medication packages. The blister pack (referred to in the following as "the blister") consists of a strip of stiff plastic material, in which deep-drawn cups are formed, which hold the pills, tablets, capsules, suppositories, etc. After the cups have been filled, they are sealed by a cover foil of limited tensile strength, which is bonded to the plastic strip. This cover foil usually consists of metal, especially aluminum. To remove the medication from the cup, the medication is pushed from the rear of the strip against the cover foil, which is thus broken open. It is obvious that the stiffness of the plastic strip material in the area of the cup has been reduced to such an extent, usually by the deep-drawing process itself, that it is possible to deform the cup by manual pressure.

BACKGROUND OF THE INVENTION

Blisters of this type are not so tamper-proof that it would be impossible, during unsupervised play, for small children to gain access to the medication present in the blister. The legislator will soon prescribe that a primary packaging means—in the present case, a blister which can be completely removed from a folding box—must be childproof. Making a blister childproof, however, demands a relatively expensive design. An example of this is described in EP 1 270 440 B1. Additional prior art involving childproof blisters can be found in U.S. Pat. No. 4,125,190 A, EP 1 057 744 A2, EP 1 002 744 A1, and U.S. Pat. No. 6,047,829 A, to name only a few. Most of these previously known blister packages, however, are childproof only up to the time they are first opened. Once the package has been broken open and is lying around without supervision, it can represent a danger to small children.

The invention is based on the task of providing a package of the type indicated above which, after it has been opened the first time, can be reclosed in such a way as to be childproof again in the legal sense.

This task is accomplished for a package of the type indicated above in that the folding box is designed to be reclosable in a childproof sense, and in that the folding box and the blister package have cooperating means which are designed to prevent the blister pack from being removed completely from the folding box.

SUMMARY OF THE INVENTION

Because, according to the present invention, the folding box and the blister are connected inseparably to each other, the folding box belongs to the primary packaging means and can therefore fulfill the childproofing function as prescribed by law, whereas the blister itself can remain unsecured, i.e. un-childproofed.

The invention proceeds from the train of thought that an adult who has opened a package of the inventive type for the first time to remove a tablet will not leave the packaging lying around open, for in this state the package represents clutter and is in general inconvenient to find and use. Instead, the adult will be induced by the type of packaging to push the blister back into the folding box and to close the folding box, as a result of which the childproofing function is reestablished.

In a preferred embodiment of the invention, the folding box has a closure flap formed as a hollow wall on one of its short, narrow sides. That panel of the closure flap which, in the closed state, is located in the body of the folding box adjacent to the outside wall of the closure flap, has at least one cut-out area extending to the fold line between it and the inner wall panel of the closure flap. A projection extending from the previously mentioned fold line projects into this cut-out area. The cardboard panel of the folding box body adjacent to this closure flap panel has, on its inside surface, a second or double layer of cardboard in the end area, which forms a cardboard edge, with which the free edge of the projection engages in the closed state of the closure flap. In the area where the projection rests against it, the previously mentioned cardboard panel of the folding box body has a tongue, which is outlined by a frame of intentionally weakened material and which can thus be pressed into the interior of the folding box, the free edge of the tongue then more-or-less covering the outline of the projection. By pressing on this tongue, the projection can be disengaged from the second or double layer of cardboard, so that the closure flap can be opened.

In this embodiment, to prevent the blister from being pulled completely out of the folding box, a projecting hook is formed on at least one of the long edges of the blister, and the interior of the folding box is provided with a locking device, which limits the travel of the hook as the blister is being pulled out of the folding box. In this embodiment, it is possible to accommodate several independent blisters in a secured manner next to each other in the folding box.

Another possibility is to provide the blister with a tongue on one of its transverse edges, which is folded over and which rests under elastic pretension against one of the body panels of the folding box. This body panel carries a cardboard edge, located in the path of movement of the tongue, which the free edge of the tongue strikes as the blister is being pulled out of the folding box, thus preventing the further movement of the blister. The previously mentioned cardboard edge can be formed by a glue tab, which serves to attach one of the walls forming the hollow closure flap to the body of the folding box.

The invention is described in greater detail below with reference to an exemplary embodiment, illustrated in the drawings:

SHORT DESCRIPTION OF THE FIGURES

DETAILED EXPLANATION OF A PREFERRED EMBODIMENT OF THE INVENTION

Figure 2:
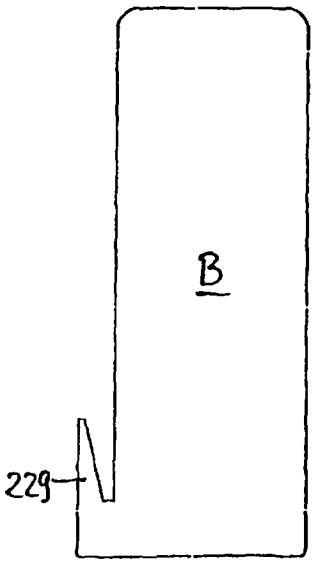
FIG. 2 shows the blister belonging to the blank of FIG. 1 (the wells not being shown)
Figure 1:
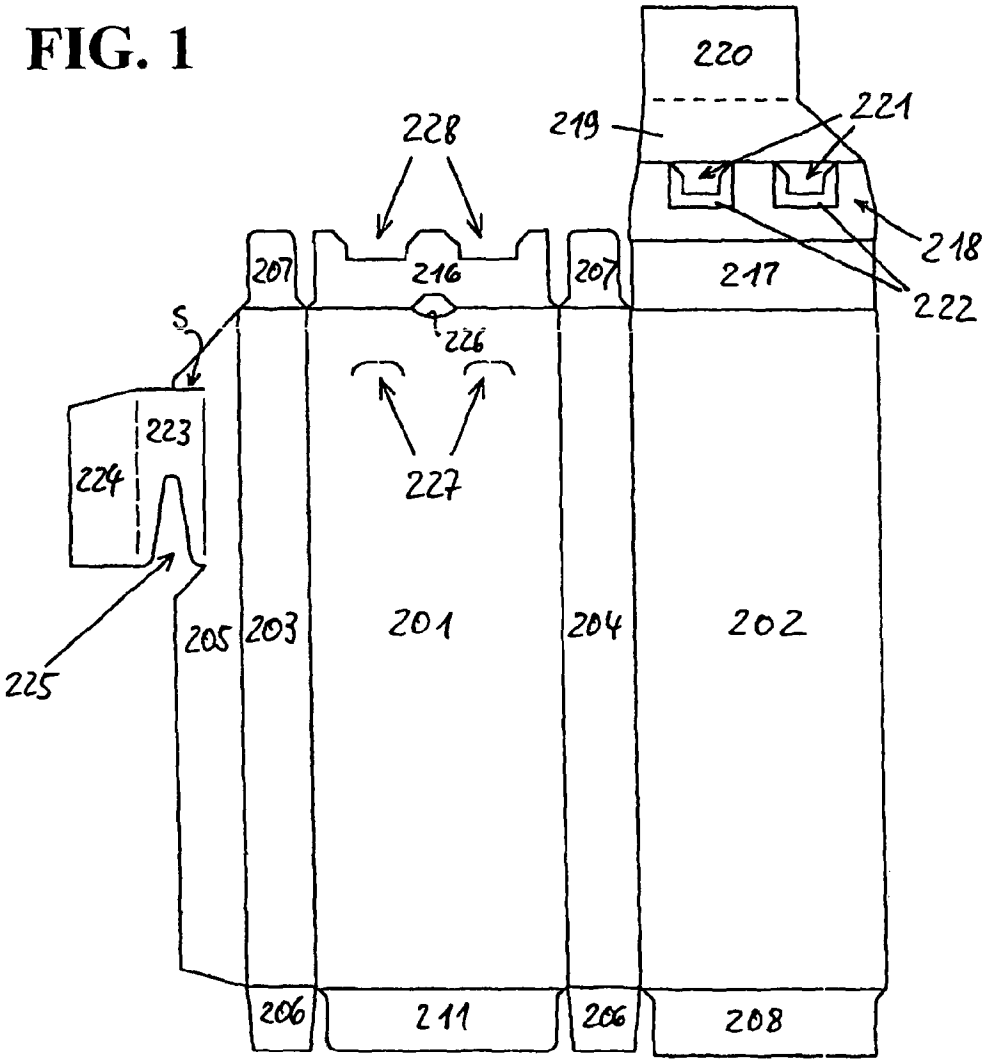
FIG. 1 shows a flat cardboard blank for a package according to a preferred embodiment of the invention.

FIGS. 1 and 2 show the individual parts of a preferred embodiment of the invention, namely, a cardboard blank and a blister. The presentation of the wells in the blister has been omitted.

FIG. 1 shows the flat cardboard blank of a folding box, consisting of two wide body panels 201, 202; two narrow body panels 203, 204; and a glue tab 205 adjoining the narrow body panel 203. At one end, glue tabs 206 and 208 and a bottom tab 211 arc attached to the body panels 201-204. At the other end, glue tabs 207 are attached to the narrower body panels 203. The wide body panel 201 carries a latching tab 216 at the end opposite the bottom tab 211. whereas the other body panel 202 holds cardboard panels which Form a kind of closure flap. This closure flap is designed as a hollow wall, consisting of a cover panel or outer wall panel 217, which adjoins the body panel 202; a layup panel 218; an inner wall panel 219; and a glue tab 220. Two elastic projections 221, which are cut from the layup panel 218 by freeing cuts 222, are attached to the fold line which separates the layup panel 218 from the inner wall panel 219.

Figure 4:
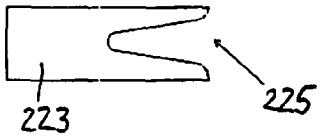
FIG. 4 shows a detail of the interior of the folding box.

By means of a transverse cut S, a short retaining wall 223 is cut from the glue tab 205; this retaining wall is separated from the glue tab 205 by a fold line. Adjoining the retaining wall 223 is a glue tab 224. The retaining wall 223 has a wedge-shaped cut-out 225 (see also FIG. 4).

It should also be noted that a cut-out 226 is located at the fold line which separates the latching tab 216 from the body panel 201. The body panel 221 has two lines of intentionally weaker material which form the boundaries of tongues 227. The distance between these intentionally weaker lines and the adjacent fold line, in which the cut-out 226 is located, is approximately equal to the distance between the stop edges 228 and the same fold line, i.e., the fold line by which the latching tab 216 is attached.

According to FIG. 2, the blister B consists of a flat, approximately rectangular strip of a sufficiently stiff material of sufficient intrinsic strength. Wells are produced in the strip to hold tablets, pills, or similar products, but the wells are not shown in the figure, because their illustration is not necessary for an understanding of the invention. At one end of a long edge, the blister B has a projecting hook 229, which is directed toward the other end of the blister.

Figure 3:
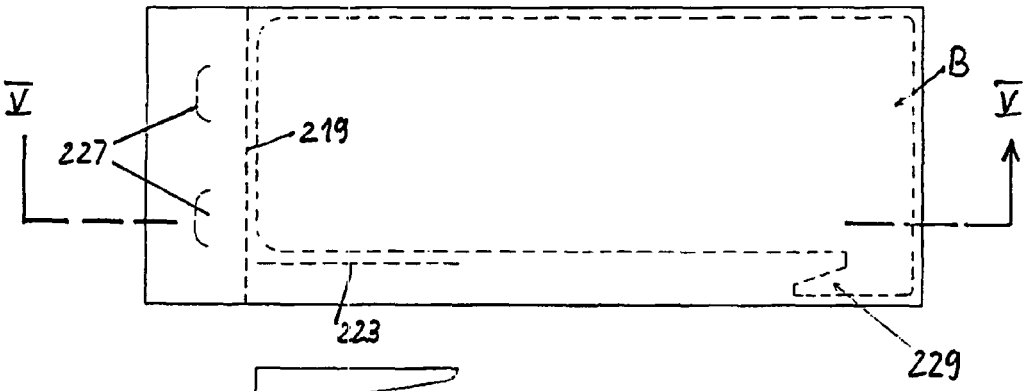
FIG. 3 shows a diagram of a folding box produced from the blank according to FIG. 1 with a blister inside.

In the finished package, as shown in FIG. 3, the blister B, shown in phantom line, is in a position in the folding box in which its hook 229 lies on the side of the folding box where a stop for the hook 229 in the form of a short retaining wall 223 is formed in the box. The hook 229 is also adjacent to the glued end of the folding box. This will be discussed again later. The folding box can be opened at the end opposite the hook 229, so that the blister B can be pulled out of the folding box. It can be seen in FIG. 3 that the path of the blister B inside the folding box is limited by the retaining wall 223, because the hook 229 runs up against it and is caught in the notch 225 formed in the retaining wall 223. The retaining wall is shown as an isolated detail in FIG. 4. The blister B can therefore not be separated from the folding box.

Figure 5:
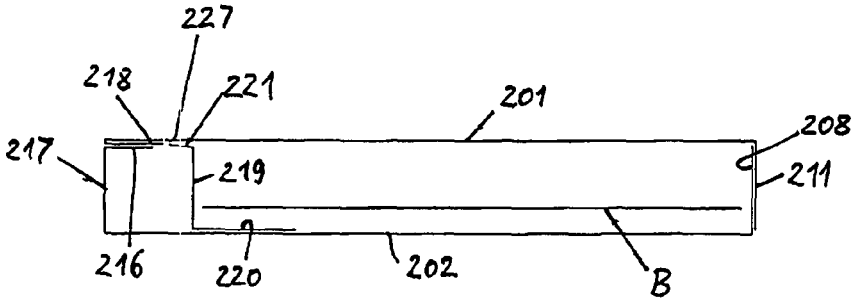
FIG. 5 shows a longitudinal cross section through the arrangement of FIG. 3 along line V-V of FIG. 3.

FIG. 5 shows a longitudinal cross section through the arrangement of FIG. 3, seen along line V-V of FIG. 3. This figure clearly shows the folding closure flap formed as a hollow wall. The reference numbers 217 and 219 are used for the outer and inner wall panels, and the reference number 221 is used for the elastic projections. The inner wall panel 219 of the closure flap is attached to the body panel 202 of the folding box by means of the glue tab 220 attached to it. The free edges of the elastic projections 221 are located at a cardboard edge formed by the layup panel 218. The blister B is thus held securely in the folding box by the closure flap.

Figure 6:
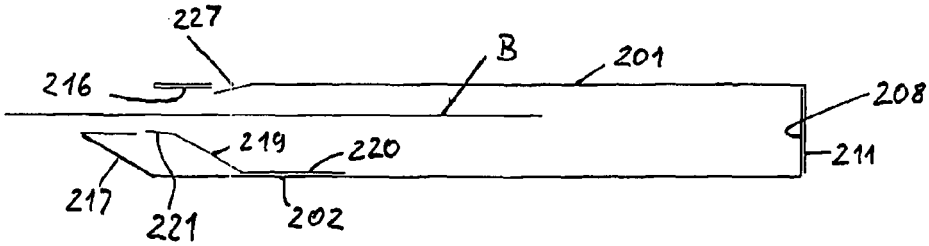
FIG. 6 shows a diagram similar to FIG. 5 in the opened state of the folding box with a partially pulled-out blister.

When the folding box is in the opened state as shown in FIG. 6, the closure flap is deformed into a hollow body with a rhombic cross section. It can be pressed completely flat under certain conditions. The interior space of the folding box is thus accessible, and the blister or blisters B can be removed from the box. It would be possible, for example, to shake them out of the box. The previously mentioned hook 229 and the retaining wall 223 prevent the blisters from falling completely out of the box.

The blank for the folding box is processed as follows. The narrow body panel 203 is folded up; the glue tab 205 is folded over; the retaining wall 223 is folded over; the glue tab 224 is folded over in the opposite direction and glued to the inside surface of the panel wall 202 adjacent to the narrow body panel. The glue tabs 207 are folded over toward the inside onto the narrow body walls 203 and 204 and glued to them. The latching tab 216 is folded over toward the inside onto the wide body panel 201 and glued to that. At the fold line which separates the cover panel 217 from the layup panel 218, the layup panel 218 is folded over toward the inside, and the glue tab 220 is glued to the wide body panel 202. The folding box is now closed by folding in the glue tabs 206 and 208 and gluing, the glue tab 205 to the inside surface of the body panel 206. Finally, the bottom tab 211 is glued to the glue tab 208, but, before that, at least one blister B (see FIG. 2) is inserted into the blank, which is still open at this point, so that the hook 229 formed on it is as far as possible from the retaining wall 223. The only remaining step is now to close the hollow-walled closure flap. As this is being done, the elastic projections 221 engage with the edges 228 of the latching tab 216. It is also possible, however, for the folding box to be fabricated completely except for the gluing at the bottom and to insert the blister or blisters into the folding box through the still-open bottom. Then the folding box would be closed at the bottom and glued.

To remove the blister B, the folding box must first be opened, for which purpose pressure is exerted on the tongues 227 to release the elastic projections 221 from their engagement with the latching tab 216. The closure flap can now be opened. The opening 226 has created an appropriate finger hole, in which, for example, the thumb can be placed. The blister in the package is now accessible; it can, for example, be shaken out, but the blister B is prevented from being removed completely. The laterally projecting hook 229 as shown in FIG. 2 is caught by the wedge-shaped cut-out 225 in the retaining wall 223. In the case of this package, several blisters B of the type shown in FIG. 2 can be stacked parallel to each other in the folding box. For reclosure, the blister is first pushed back into the folding box, and then the closure flap is closed. As this is being done, the projections 121 slide behind the latching tab 216 and, because of the elastic action of the cardboard material, their free ends engage with the stop edges 228.

If, as in the example shown here, two elastic projections 221 are provided, the folding box is especially childproof, because it is necessary to press on both tongues 227 while simultaneously pulling the closure flap out of the folding box, for it does not pop out by itself. It is obvious, however, that, under certain conditions, only one elastic projection and the associated tongue could be used.

A small child is unable to perform the combination of movements necessary to open the folding box, because the required movements proceed in different directions. The folding box is therefore childproof, and because the blisters cannot be separated from it, the overall package represents a primary package which fulfills the child safety regulations without the need for the blister itself to be childproof.

The invention claimed is:

1. A childproof resealable package comprising:

a parallelepiped block-shaped folding box made of cardboard having (a) first and second narrow longitudinal walls, (b) first and second wide longitudinal walls, (c) first and second ends which with the narrow and wide longitudinal walls define an interior, the first end being a withdrawal end and the second end being a closed end, (d) a retaining wall member along the first narrow longitudinal wall, the retaining wall member defining a cut-out area and having a fold line, the cut-out area extending to the fold line, and (e) a closure flap along the second wide longitudinal wall, the closure flap being a hollow wall, the closure flap defining a cover flap, a layup panel with a projection, an inner wall panel, and an outer wall panel; and at least one strip-form blister pack within the interior which is withdrawable therefrom at the withdrawal end and has a projecting-hook extending from a longitudinal edge thereof into the cut-out area for locking, the cut-out area and projecting-hook being configured and arranged such that the projecting-hook engages the cut-out area to prevent withdrawal of the at least one strip-form blister pack from the interior.

2. The package according to claim 1 wherein:

the inner wall panel, when the closure flap is in a closed state, is located in a body of the folding box and is adjacent to the outer wall panel of the closure flap;

the projection in the layup panel extends along a fold line with the inner wall panel into at least one freeing cut;

the first wide longitudinal panel adjacent to the closure flap has, in an end area, a second layer of cardboard on an inside surface of the first wide longitudinal panel, the second layer forming a cardboard edge with which a free edge of the projection engages when the closure flap is in the closed state; and the first wide longitudinal panel has, in an area where the projection rests against it, at least one tongue, which is outlined by an intentional break line and which is pushed into the folding box, the at least one tongue having a free edge which covers an outline of the projection.

3. The package according to claim 1 in which the at least one strip-form blister pack has two long edges and a projecting-hook is formed on at least one edge of the two long edges, the retaining wall member is formed on an inner wall of the folding box adjacent to the long edge with the projecting-hook, the retaining wall member limits the travel of the projecting-hook as the at least one strip-form blister pack is pulled out from the folding box.

4. The package according to claim 3 in which the projecting-hook includes an opening facing the closure flap of the folding box.

5. The package according to claim 3 in which the retaining wall member is part of a blank from which the folding box is produced, the retaining wall member extending in a longitudinal direction of the folding box.

* * * * *